US006139380A

United States Patent [19]

Uematsu

[11] Patent Number: 6,139,380

[45] Date of Patent: Oct. 31, 2000

[54] COMPACT POWER TILT AND TRIM UNIT FOR MARINE DRIVE

[75] Inventor: Yoshikatsu Uematsu, Kakegawa, Japan

[73] Assignee: Soqi Kabushiki Kaisha, Japan

[21] Appl. No.: 09/228,436

[22] Filed: Jan. 11, 1999

[30] Foreign Application Priority Data

Jan. 9, 1998 [JP] Japan ..... 10-015006
Jan. 9, 1998 [JP] Japan ..... 10-015007

[51] Int. Cl.[7] ..... B63H 5/125

[52] U.S. Cl. ..... 440/61

[58] Field of Search ..... 440/1, 2, 53, 56, 440/61, 65

[56] References Cited

U.S. PATENT DOCUMENTS 5,032,094 7/1991 Katogi ..... 440/61
5,049,099 9/1991 Ito et al. .
5,149,285 9/1992 Kinoshita ..... 440/61
5,358,436 10/1994 Soda et al. ..... 440/61
5,718,613 2/1998 Nakamura .
5,746,055 5/1998 Nakamura et al. .

*Primary Examiner*—Stephen Avila
*Attorney, Agent, or Firm*—Knobbe, Martens, Olson & Bear, LLP

[57] ABSTRACT

A tilt and trim adjustment mechanism includes an improved arrangement of a powering unit in order to reduce the size of the assembly, including the size of the hydraulic motor used to raise and lower the outboard motor. The powering unit is mounted on a lower end of the hydraulic motor so that the brackets of an associated coupling assembly (i.e., swivel and clamping brackets) do not have to be widened in order to accommodate the tilt and trim adjustment mechanism. In addition, the hydraulic motor can be arranged to position the motor at the center of the assembly. By having the hydraulic motor act at the center of gravity of the assembly, a smaller hydraulic motor can be used. In addition, the tilt and trim adjustment system includes an improved manual override valve that includes a push button actuator. No tools are required to open the valve. In addition, the button is conveniently located on the powering assembly to be accessible for manually lowering the outboard motor.

28 Claims, 13 Drawing Sheets

COMPACT POWER TILT AND TRIM UNIT FOR MARINE DRIVE

BACKGROUND OF THE INVENTION

1. Field of the Invention

This invention relates to a marine propulsion unit for a watercraft, and more particularly to a tilt and trim adjustment system for a marine propulsion unit.

2. Description of Related Art

Outboard motors with four-cycle engines have grown in popularity in recent years, due in part to environmental concerns associated with two-cycle outboard motors. The application of four-cycle engines in outboard motors, however, has raised some challenges, especially with large horse power engines. A four-cycle engine will weigh significantly more that a two-cycle engine that produces a comparable horsepower to that of the four-cycle engine. The additional weight creates problems for the conventional hydraulic power tilt and trim systems used with the outboard motor.

A hydraulic power tilt and trim system supports an outboard motor on a watercraft, and adjusts the trim and tilt position of the outboard motor. A tilt and trim adjustment mechanism of the system commonly includes at least one hydraulic actuator which operates between a clamping bracket and a swivel bracket. The clamping bracket is attached to the watercraft and the swivel bracket supports the outboard motor. A pivot pin connects together the swivel and clamping brackets. The actuator causes the swivel bracket to pivot about the axis of the pivot pin, relative to the stationary clamping bracket, to raise or lower the outboard drive.

Tilt and trim adjustment mechanisms also usually employ a powering unit that affects the trim and tilt operations of the outboard motor. For this purpose, powering units have included a reversible electric motor that selectively drives a reversible fluid pump. The pump pressurizes or depressurizes the actuator for raising or lowering the outboard motor.

In particular, the fluid pump supplies pressurized fluid to various ports of the actuator's closed cylinder, on either side of a piston which slides within the cylinder. The piston forms separate chambers within the cylinder. A conventional seal, such as one or more O-rings, operates between the piston and cylinder bore to prevent flow from between the chambers. The piston moves within the cylinder by pressurizing the chamber on one side of the piston and depressurizing the other chamber on the opposite side.

An actuator arm is attached to the piston and to the swivel bracket. The other end of the cylinder is attached to the clamping bracket. By pressurizing and depressurizing the chambers within the actuator, the piston and thus the outboard motor can be moved.

The actuator and powering unit often are located adjacent to each other in a side-by-side relationship, as illustrated in U.S. Pat. No. 5,049,099. The powering assembly formed by the pump, reservoir and motor, extends along side the actuator for most of the actuator's length. Both the actuator and the powering unit lie between bracket arms of the clamping and swivel brackets. While these components are shielded in this position, the resulting assembly off sets the actuator from the center of gravity of the outboard motor. That is, the stroke axis of the actuator and the center of gravity of the outboard motor which it moves, are not within the same plane. Consequently more force is required to raise the outboard motor, which increases the size of the actuator.

With smaller two-cycle engines, this result was acceptable; however, the heavier four-cycle motors exacerbate this problem.

Moreover, the swivel and clamping brackets must be reinforced to handle the increased weight. The brackets also must be widened, which requires additional reinforcing, to accommodate the resulting larger sizes of the actuator, motor, reservoir and pump. Such reinforcing increases the size and weight of the brackets, as well as increases the manufacturing cost.

Prior powering units also include a valve that allows the outboard motor to be raised (i.e., tilted up) and lowered manually when the electric motor is not functioning. The valve, when open, places a chamber of the actuator in communication with the reservoir and/or with the opposite cylinder chamber in order to move the actuator by hand. This valve, however, commonly must be rotated with an aid of a tool, which makes actuation of the valve inconvenient. The tool also is often lost or misplaced by the watercraft owner.

SUMMARY OF THE INVENTION

A need therefore exists for an improved construction of a power tilt and trim system that can support heavier outboard motors without significant reinforcement of the clamping assembly of the system.

An aspect of the present invention thus involves an improved tilt and trim adjustment mechanism for use between a clamp bracket and a swivel bracket of a power tilt and trim system. The tilt and trim adjustment mechanism includes an actuator having at least a first variable volume fluid chamber and an extendable rod. The actuator is arranged to operate generally between the clamp and swivel brackets. A pump selectively supplies working fluid to the first fluid chamber of the actuator so as to move the rod, and a motor selectively drives the pump. The pump and motor are located near to an interaction point between the actuator and the clamp bracket, at the lower side of the actuator. In this position, the spacing between support arms of the clamp and swivel brackets need not be widened to accommodate the tilt and trim adjustment mechanism. In addition, the actuator can be centrally located relative to the brackets, and thus, better aligned with the center of gravity of the outboard motor supported by the brackets.

Another aspect of the present invention involves the recognition that outboard motors are hardly ever tilted up by hand, and this feature results in an overly complicated hydraulic circuit of the tilt and trim adjustment mechanism. The complicated circuit increases the size of the powering unit, as well as manufacturing costs. A need therefore exists for a tilt and trim adjustment mechanism with an improved manual valve that is easily actuated and simplifies the hydraulic circuit in which it is employed.

One aspect of the present invention thus involves a hydraulic tilt and trim adjustment mechanism including an actuator having at least one variable volume fluid chamber. A pump selectively supplies working fluid to the fluid chamber of the actuator through a fluid circuit. A reservoir contains working fluid that the pump delivers to the actuator. The fluid circuit includes a valve assembly having a push button and a valve member. The valve member is positioned within the fluid circuit to selectively place the fluid chamber of the actuator in communication with the reservoir when actuated by the push button. The push button is located on the tilt and trim adjustment system so as to be accessible for manual operation. In a preferred mode, the valve member communicates with only an up fluid chamber of the actuator to simplify the hydraulic circuit.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the present tilt and trim adjustment mechanism, which are intended to illustrate, but not to limit, the present invention. However, a power tilt and trim system and components thereof, which are configured in accordance with other designs will first be described in order to enhance an understanding of the advantages associated with the present tilt and trim adjustment mechanism. The drawings contain the following figures.

BRIEF DESCRIPTION OF OTHER TILT AND TRIM ADJUSTMENT SYSTEM DESIGNS

The following describes several designs of components of a tilt and trim adjustment system and explains the disadvantages associated with such designs. The designs will later be referred to when discussing the advantages of the present tilt and trim adjustment system.

Figure 1:
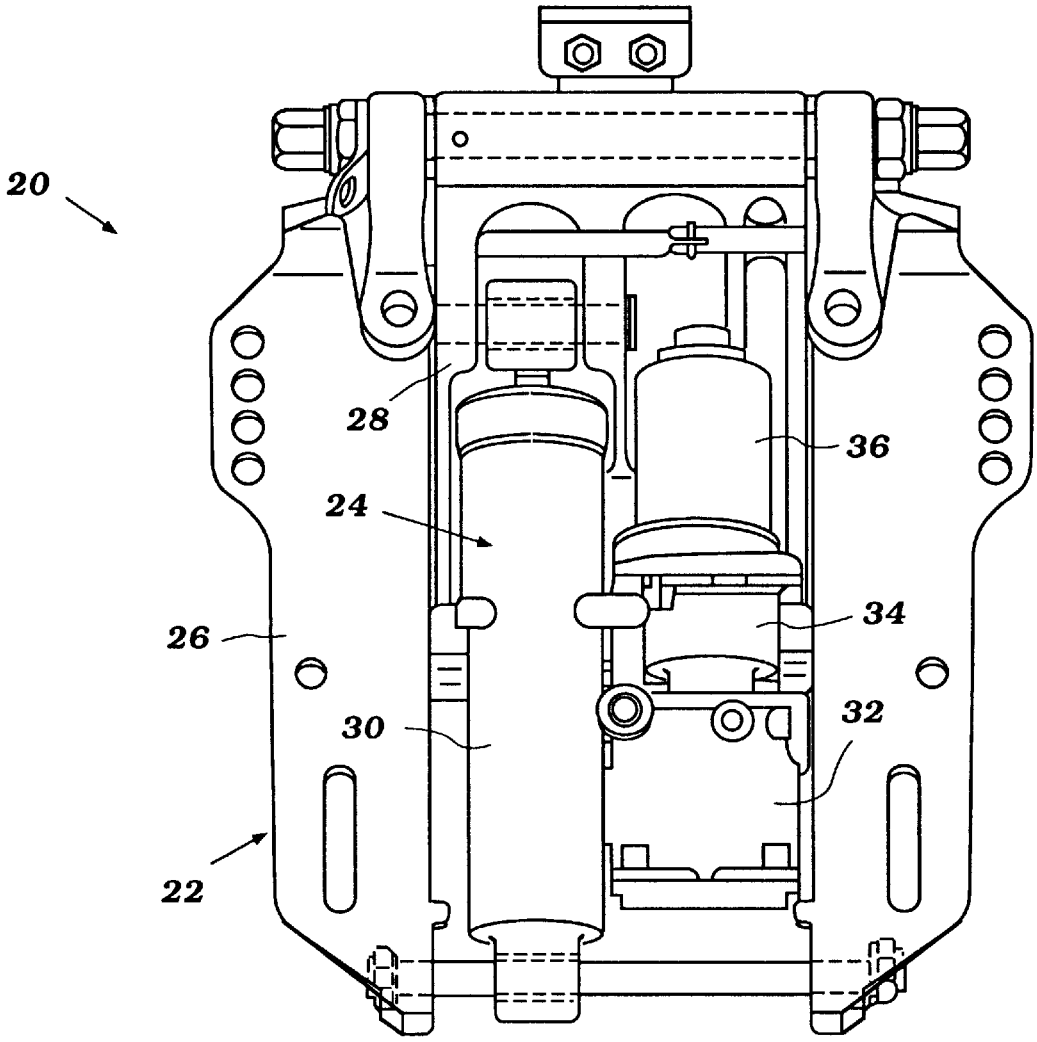
FIG. 1 is a front elevational view of a tilt and trim adjustment system configured in accordance with a previous design.

FIG. 1 illustrates a previous design of a power tilt and trim system 20. The system includes a clamping assembly 22 and a tilt and trim adjustment mechanism 24. The clamping assembly has a swivel bracket 26 attached to a clamp bracket 28 in a conventional manner.

The tilt and trim adjustment mechanism 24 includes an actuator 30, a reservoir 32, a pump 34 and an electric motor 36. The reservoir 32, pump 34, and the electric motor 36 are arranged next to the actuator 30. The combined length of these staked components generally matches the length of the unextended actuator 30. The actuator 30 and the stacked reservoir 32, pump 34 and motor 36 are positioned between the arms of the clamp bracket 28, as seen in FIG. 1.

Figure 2:
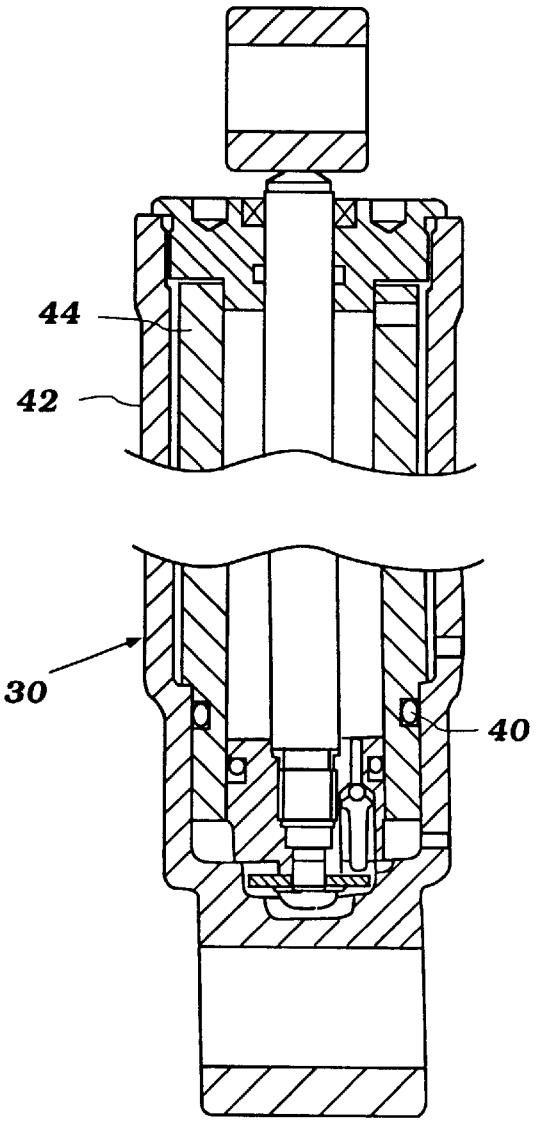
FIG. 2 is a partial, cross-sectional view of an actuator of the tilt and trim adjustment system of FIG. 1.

FIG. 2 illustrates one possible construction of the actuator 30. An O-ring 40 is provided in contact surfaces of an outer cylinder 42 and an inner cylinder 44 for preventing leaks between a gap between the outer cylinder leading to an upper hydraulic chamber and a lower hydraulic cylinder. The O-ring 40 is fitted in a recess formed in the inner cylinder 44. For reinforcing at this area, one or both of the cylinders includes an increased wall thickness, which increases the weight of the cylinder.

Figure 3:
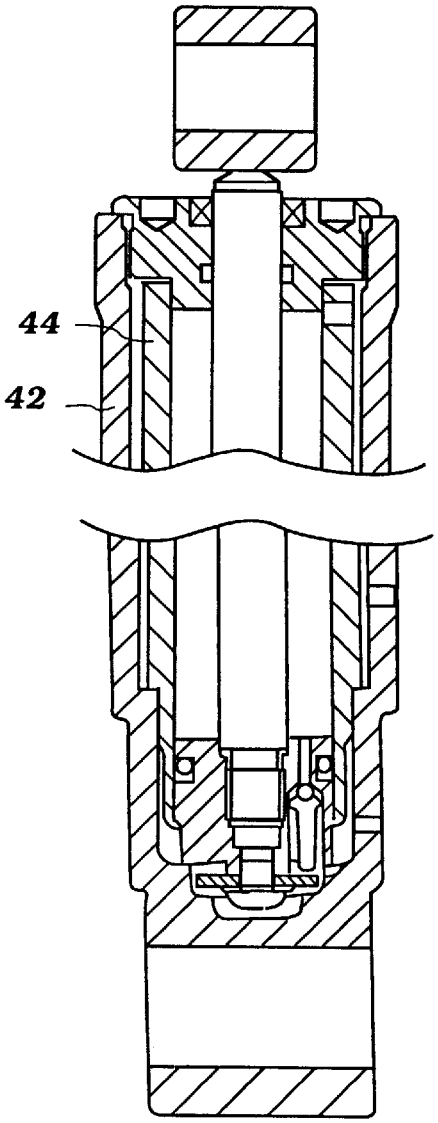
FIG. 3 is a partial, cross-sectional view of an actuator, configured in accordance with another previous design, which can be used with the tilt and trim adjustment system of FIG. 1.

FIG. 3 illustrates another actuator configured in accordance with another possible design. This design eliminates the O-ring by constructing the inner and outer cylinders 42, 44 to mechanically fit tightly together. If one of the cylinders is made of a different type of material, however, the seal between the two cylinders can become insufficient due to thermal expansion and contraction of the inner and outer cylinders.

Figure 4:
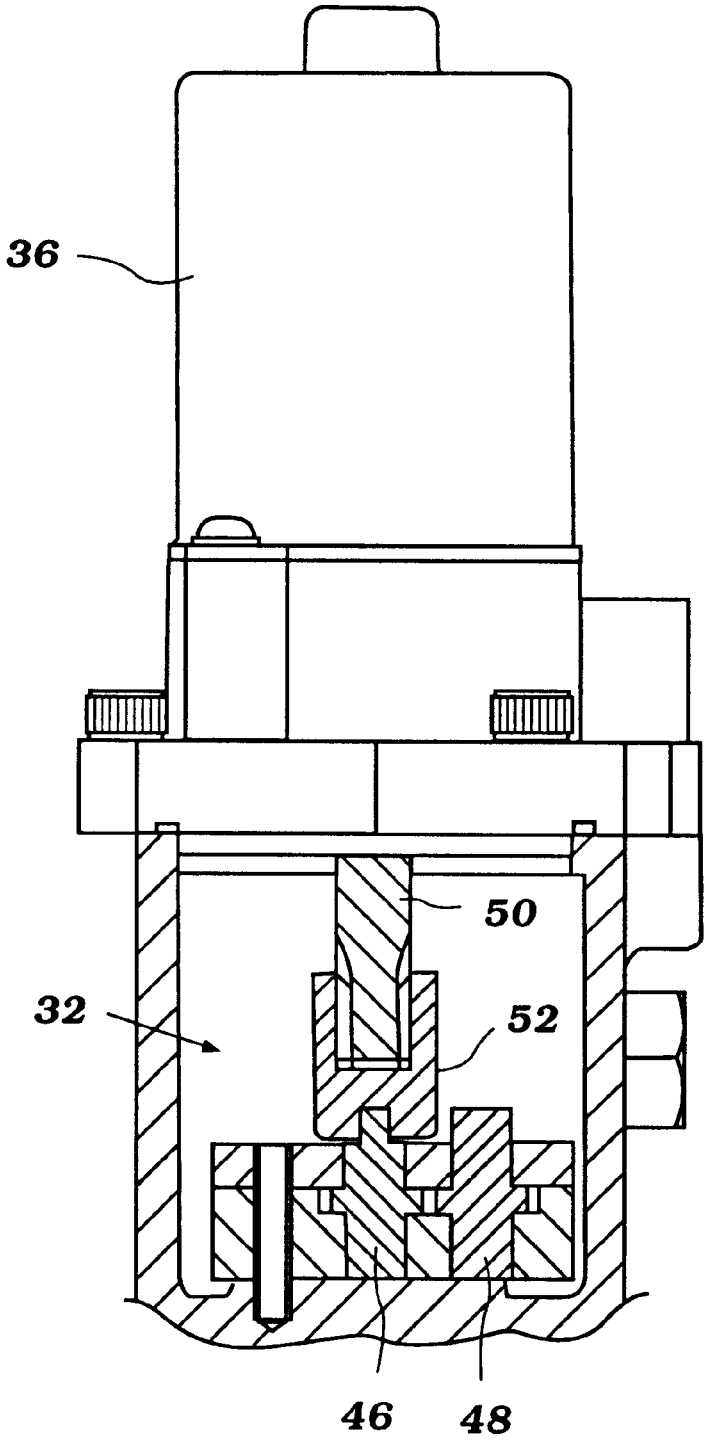
FIG. 4 is a partial, cross-sectional view of a hydraulic pump of the tilt and trim adjustment system of FIG. 1.

FIG. 4 illustrates a possible hydraulic pump design for the power tilt and trim system. This pump design leads to a larger than necessary size of the powering assembly. As seen in FIG. 4, shafts are employed for each gear 46, 48 of the gear pump. One of the gears drives the other and is located about the same axis as an output shaft 50 of the electric motor 36. In addition, a coupling 52 interconnects the output shaft 50 to the shaft of the drive gear 46 to further lengthen the pump assembly 34.

Figure 5:
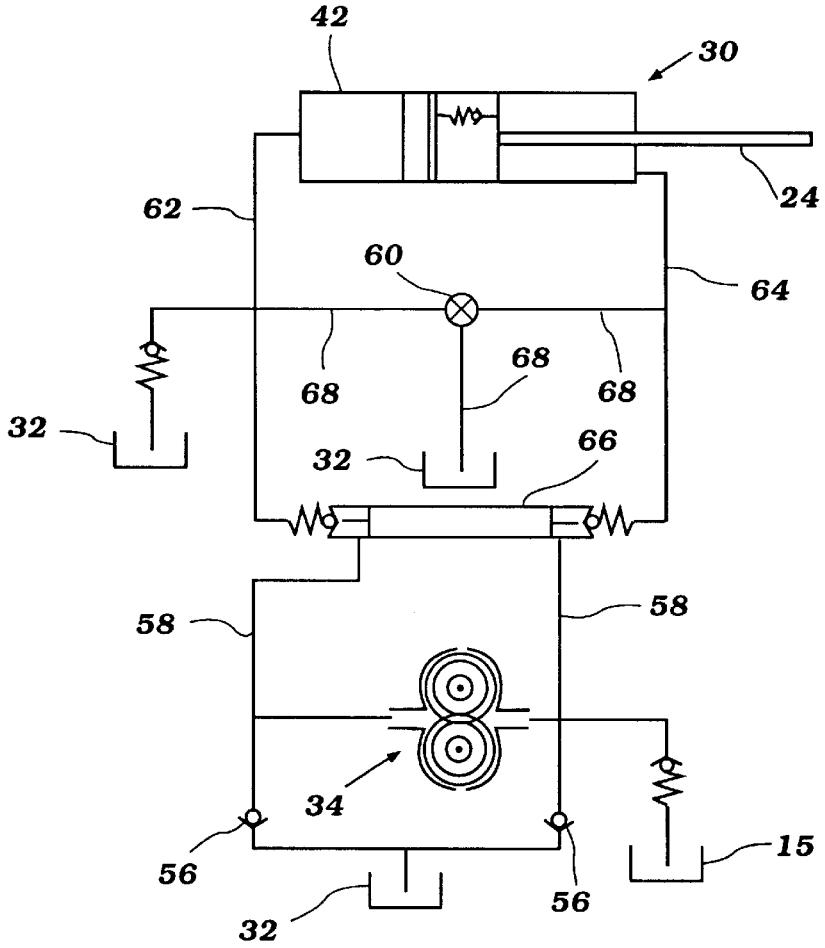
FIG. 5 is a schematic drawing of the hydraulic circuitry of the tilt and trim adjustment system of FIG. 1.

FIG. 5 illustrates a hydraulic circuit with conventional one-way valves 56 in the suction passages 58. The circuit includes too many parts and requires a complicated assembly process. This circuit also is susceptible to leakage across the valves 56.

Figure 6:
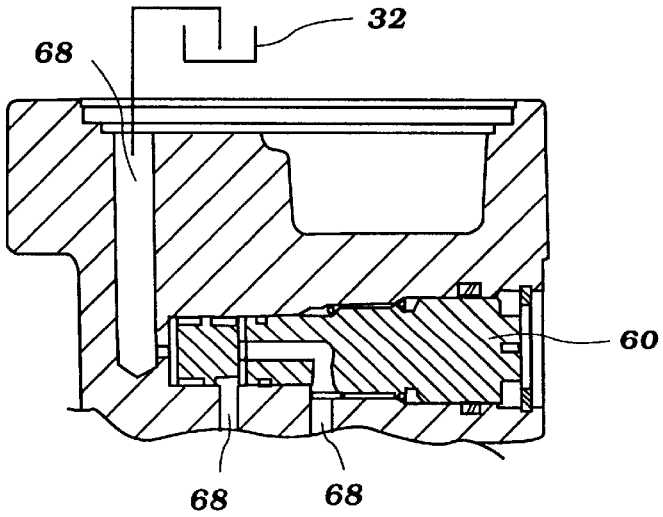
FIG. 6 is a partial sectional, enlarged view of a manual valve of the hydraulic circuitry schematically represented in FIG. 5.

As also seen in FIGS. 5 and 6, a manual valve 60 is provided between pressure passages 62, 64 of the hydraulic circuit that extend between the chambers of the cylinder body 30 and a main valve 66 that selectively places the pump 34 in communication with the cylinder 30. For an easy manual tilt-up and tilt-down operations of the outboard motor, as shown in FIG. 6, a bypass passage 68 extends between the pressure passages 62, 64 with the manual valve 60 located within the bypass passage 68. The manual valve 60 is rotated by using a tool so that the hydraulic fluid is returned to the reservoir 32 from either one of the passages 62, 64.

The conventional circuit is configured to provide for both manual tilt-up and tilt-down of the outboard motor.

However, as noted above, the outboard motor is hardly ever manually tilted-up when the motor or pump is not functioning. Because this structure requires the bypass passage 66 to be connected to both passages 62, 64 and the valve 60 to be positioned between both passages 62, 64 and the reservoir, for each oil passage, a complicated hydraulic circuit results. It is further disadvantageous because operation of the manual valve 60 depends on the cumbersome use of a tool. That is, the valve is located within the housing and must be rotated using a tool, as noted above.

DETAILED DESCRIPTION OF PREFERRED EMBODIMENTS OF THE PRESENT INVENTION

Figure 7:
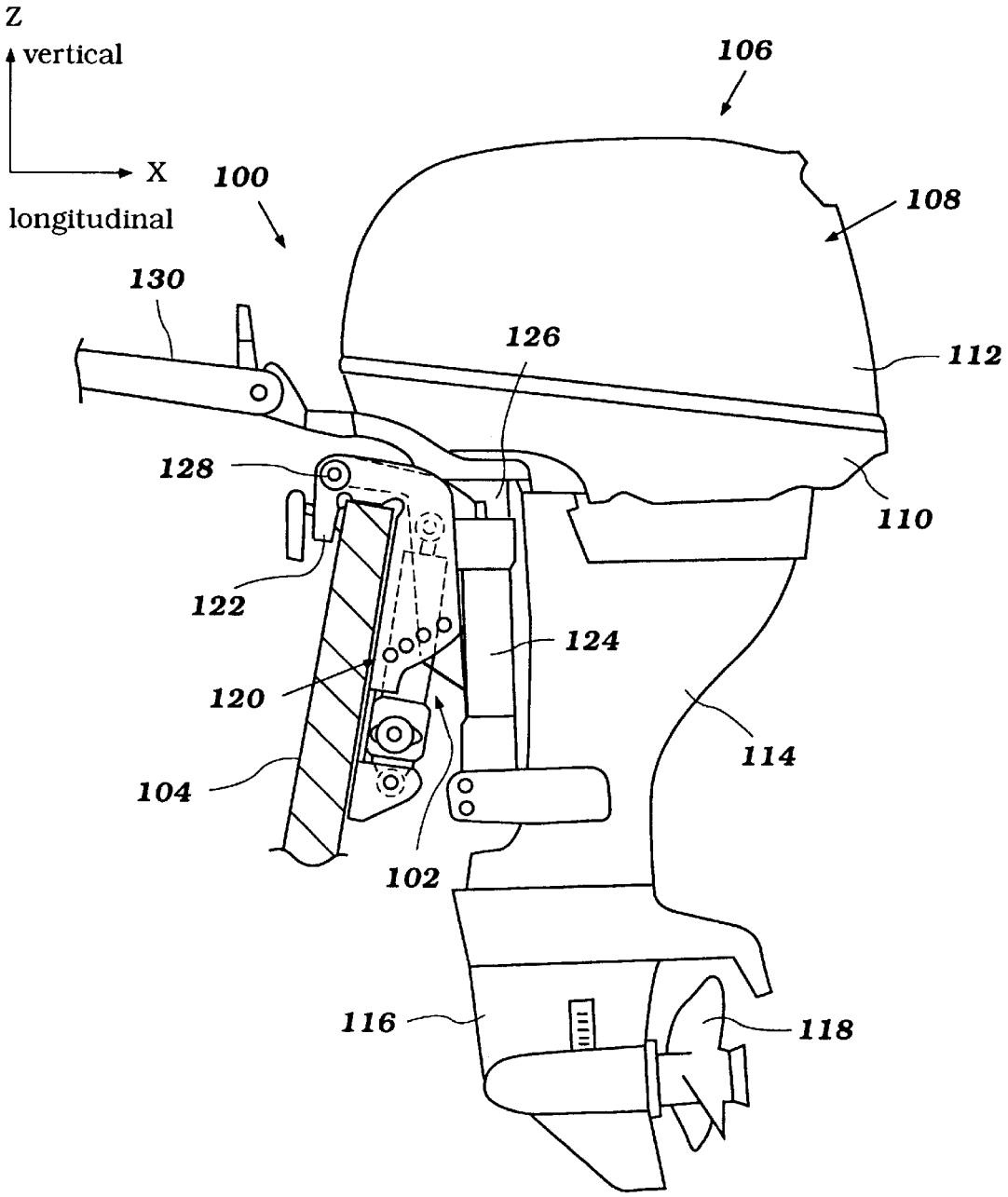
FIG. 7 is a side elevational view of an outboard motor, which includes a hydraulic tilt and trim adjustment system configured in accordance with a preferred embodiment of the invention. The outboard motor is illustrated as attached to the transom of an associated watercraft in a fully trimmed-down position.

FIG. 7 illustrates an exemplary outboard motor 100 which incorporates a hydraulic tilt and trim adjustment system 102 configured in accordance with the present invention. Because the present tilt and trim adjustment system has particular utility with an outboard motor, the following describes the tilt and trim unit in connection with such an outboard motor; however, the depiction of the invention in conjunction with an outboard motor is merely exemplary. Those skilled in the art will readily appreciate that the present tilt and trim adjustment system can be readily adapted for use with other types and sizes of marine drives.

In the illustrated embodiment, the tilt and trim adjustment system 102 supports the outboard motor 100 on a transom 104 of an associated watercraft. An exemplary outboard motor is illustrated in FIG. 7, and the following will initially describe the outboard motor in order to provide the reader with an understanding of the illustrated environment of use.

The outboard motor 100 has a power head 106 which desirably includes an internal combustion engine. The internal combustion engine can have any number of cylinders and cylinder arrangements, and can operate on a variety of known combustion principles (e.g., on a two-stroke or a four-stroke principle).

A protective cowling assembly 108 surrounds the engine. The cowling assembly 108 includes a lower tray 110 and a top cowling 112. The tray 110 and the cowling 112 together define a compartment which houses the engine with the lower tray 110 encircling a lower portion of the engine.

The engine is mounted conventionally with its output shaft (i.e., a crankshaft) rotating about a generally vertical axis. The crankshaft drives a drive shaft, as known in the art. The drive shaft depends from the power head 106 of the outboard motor 100.

A drive shaft housing 114 extends downwardly from the lower tray and terminates in a lower unit 116. The drive shaft extends through the drive shaft housing 114 and is suitably journaled therein for rotation about the vertical axis.

The drive shaft continues into the lower unit 116 to drive a propulsion shaft through a transmission. The propulsion shaft drives a propulsion device 118 which the lower unit 116 supports.

In the illustrated embodiment, the propulsion device 118 comprises a propeller. The propulsion device, however, can take the form of a dual, counter-rotating propeller system, a hydrodynamic jet, or like propulsion device.

A coupling assembly 120 of the power tilt and trim system supports the outboard motor 100 on the watercraft transom 104 so as to position the propulsion device 118 in a submerged position with the watercraft resting on the surface of a body of water. The coupling assembly 120 is principally formed between a clamp bracket 122, a swivel bracket 124, a steering shaft 126, and a pivot pin 128.

The steering shaft 126 is affixed to the drive shaft housing 114 through upper and lower brackets. An elastic isolator connects each bracket to the drive shaft housing 114 (or to a section of the outboard motor connected to the drive shaft housing, e.g., an exhaust guide located beneath the engine). The elastic isolators permit some relative movement between the drive shaft housing 114 and the steering shaft 126 and contain damping mechanisms for damping engine vibrations transmitted from the drive shaft housing 114 to the steering shaft 126.

The steering shaft 126 is rotatably journaled for steering movement about a steering axis within the swivel bracket 124. A steering actuator 130 is attached to an upper end of the steering shaft 126 to steer the outboard motor 100, in a known manner. Movement of the actuator 130 rotates the steering shaft 126, as well as the drive shaft housing 114 which is connected through the upper and lower brackets about the steering axis.

The swivel bracket 124 includes a cylindrical housing through which the steering shaft 126 extends. A plurality of bearing assemblies journal the steering shaft 126 within the cylindrical housing. And as seen in FIG. 10, the swivel bracket 224 includes a pair of bracket arms 127 that are positioned in front of the cylindrical housing and project toward the clamping bracket 122.

The swivel bracket 124 also includes a pair of lugs which project forward toward the watercraft transom 104. Each lug includes a coupling hole at its front end. The coupling holes are aligned with each other along a common pivot axis.

As seen in FIG. 7, the clamping bracket 122 is affixed in a conventional manner to the transom 104. The clamping bracket 122 includes a support plate. The support plate abuts the outer surface of the transom 104 when the clamping bracket 122 is attached to the watercraft.

Figure 10:
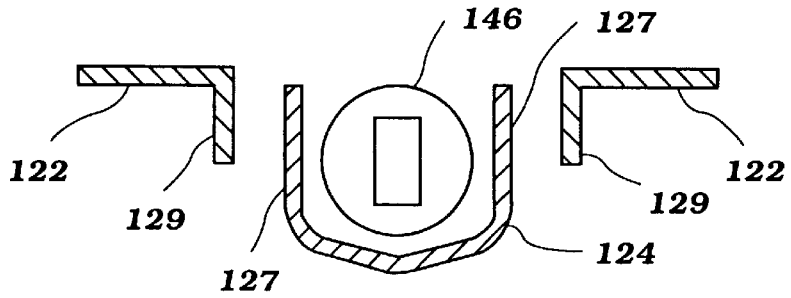
FIG. 10 is a cross-sectional view of the hydraulic tilt and trim adjustment system of FIG. 9, taken along line B—B.

A pair of flanges 129 project toward the outboard motor 100 from the sides of the support plate, as seen in FIG. 10. The flanges 129 are spaced apart from each other by a sufficient distance to receive the swivel bracket 124 between the flanges. The flanges 129 also shield the space between the support plate and the cylindrical housing of the swivel bracket 124 to protect the inner components of the tilt and trim adjustment system 102, as appreciated from FIG. 8.

The pivot pin 128 completes the hinge coupling between the clamping bracket 122 and the swivel bracket 124. The pivot pin 128 extends through the aligned coupling holes of the clamping bracket and the swivel bracket lugs and is fixed to the clamping bracket. The inner surfaces of the coupling holes through the swivel bracket lugs act as bearing surfaces as the swivel bracket 124 rotates about the pivot pin 128. The outboard motor 100 thus can be pivoted about the pivot axis defined by the pivot pin 128, through a continuous range of trim positions. In addition, the pivotal connection permits the outboard motor 100 to be trimmed up or down, as well as to be tilted up and out of the water for storage or transport, as known in the art.

The hydraulically-operated tilt and trim adjustment mechanism 102 operates between the clamping bracket 122 and the swivel bracket 124 to effectuate the tilt and trim movement of the outboard motor 100. While the present embodiment is described in the context of a hydraulic system, other types of working fluids (e.g., air, nitrogen) can also be used.

The tilt and trim adjustment mechanism 102 will now be described with additional reference to FIGS. 8 through 14B. In order to describe the present system, a coordinate system is provided that includes a longitudinal axis X, a lateral axis Y, and a vertical axis Z. With the outboard motor positioned on a watercraft when afloat, the longitudinal axis X extends generally in the direction from bow to stem and parallel to the surface of the body of water in which the watercraft is floating, the lateral axis Y extends normal to the longitudinal axis and parallel to the water surface, and the vertical axis Z extends normal to both the longitudinal and lateral axes, as best understood from FIGS. 7 and 9.

Figure 8:
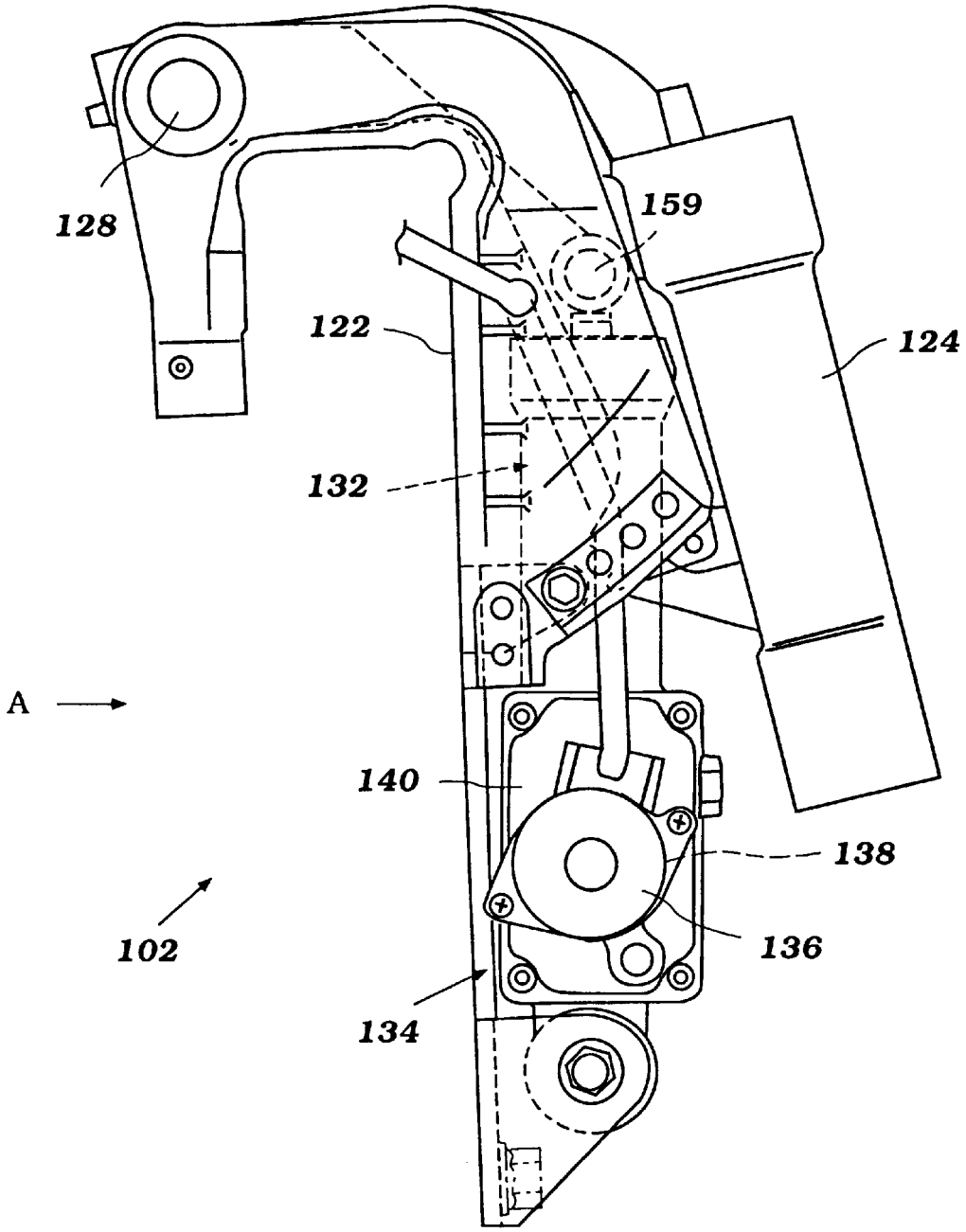
FIG. 8 is an enlarged elevational side view of the hydraulic tilt and trim adjustment system of FIG. 7, isolated from the outboard motor.
Figure 9:
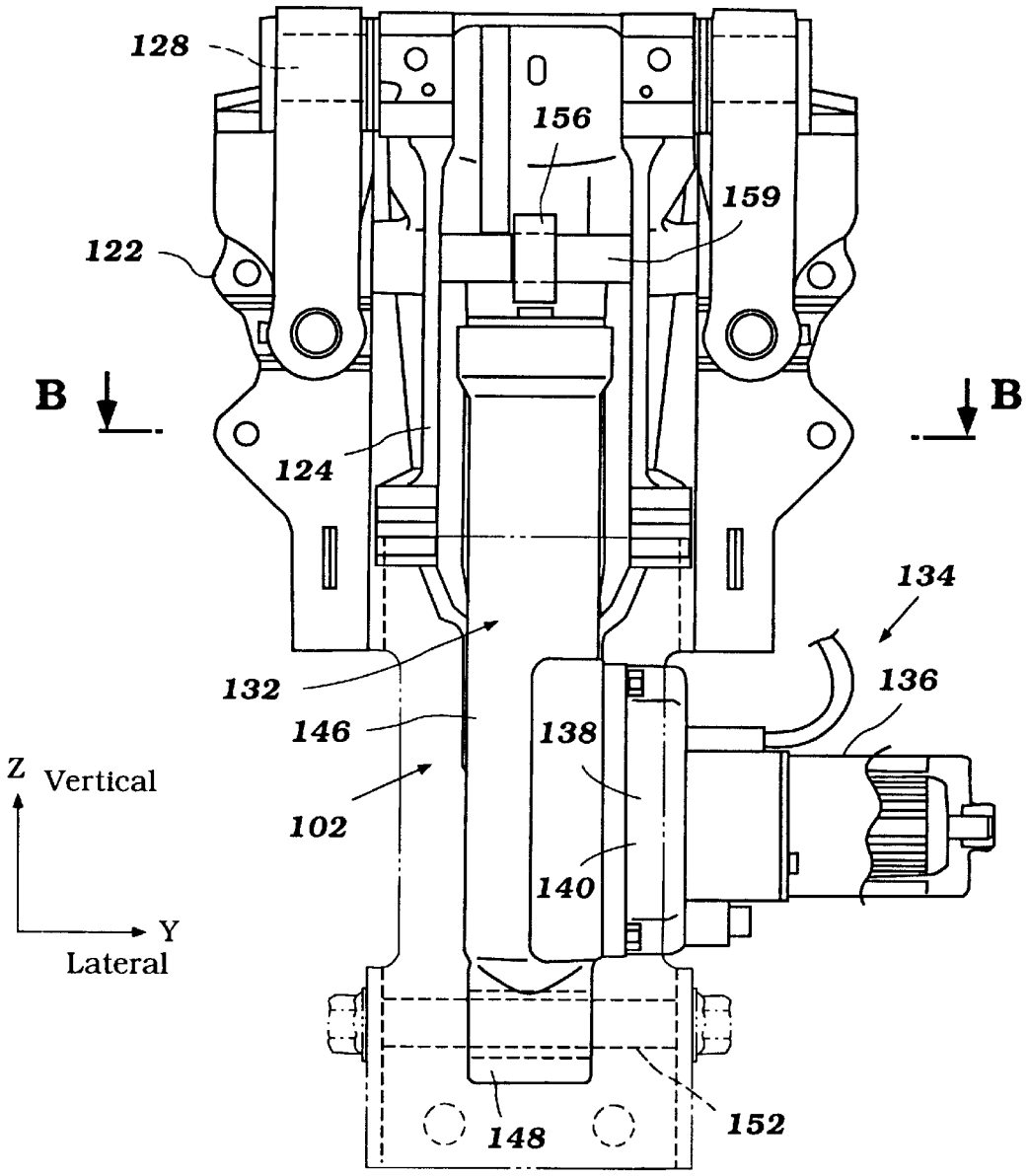
FIG. 9 is a front elevational view of the hydraulic tilt and trim adjustment system of FIG. 8 as viewed in the direction of arrow A.

As best seen in FIGS. 8 and 9, the tilt and trim adjustment mechanism 102 in the illustrated embodiment includes a hydraulic motor assembly, indicated generally by the reference numeral 132. The hydraulic motor assembly 132 is located adjacent to a powering assembly 134 of the tilt and trim adjustment system 102, the particular arrangement of which will be described in greater detail below.

Figure 12:
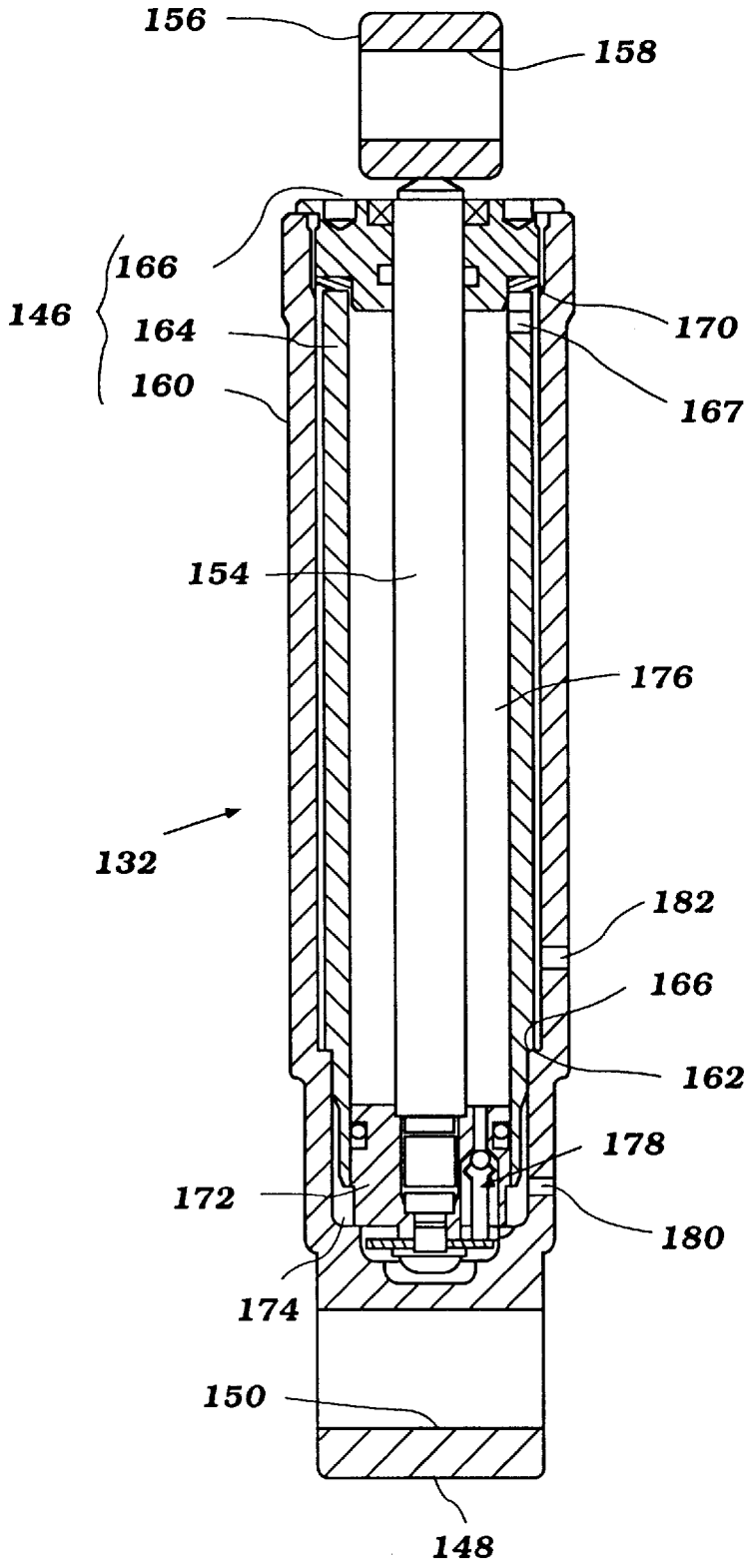
FIG. 12 is a cross-sectional view taken through an actuator cylinder of the tilt and trim adjustment system with the cylinder in a position corresponding to the fully trimmed-down position.

The powering assembly 134 includes a reversible electric motor 136 and a reversible hydraulic pump 138. The pump 138 communicates with a fluid reservoir 140 and is driven by the electric motor 136. In addition, a suitable hydraulic circuit links the pump 138 to the motor assembly 132. As best seen in FIGS. 9 and 12, the hydraulic motor 132 includes an actuator cylinder 146 having a trunnion 148 with a bore 150 that receives a pin 152 to provide a pivotal connection to the clamping bracket 122, and specifically to the side plates.

An actuator arm or rod 154, that projects beyond an upper end of the cylinder 146, also has a trunnion 156 with a bore 158. The trunnion bore 158 receives a pivot pin 159 that pivotally connects the actuator arm 154 to the swivel bracket 124 via the pivot pin 159.

The actuator cylinder 146 includes an outer cylindrical body 160 having a closed lower end and an open upper end with an inner cylindrical space defined therebetween. The inner space has a smaller diameter at an end closest to the lower trunnion 148 than it does at an end closest to the upper trunnion 156. An annular step 162, which is formed on an inner surface of the outer cylindrical body 160, creates this diameter change. In the illustrated embodiment, the step 162 is formed near the closed lower end of the cylindrical body 160.

An inner cylindrical member 164 is placed within the inner space of the cylindrical body 160. The inner cylindrical member 164 has a tubular shape with a generally constant inner diameter that is smaller than the inner diameter of the cylindrical body 160 at its lower end. The inner cylindrical member 164, however, has an annular step 166 in its outer diameter such that only its lower end fits within the lower inner space of the cylindrical body 160. The step 166 of the inner cylindrical member 164 abuts the inner step 162 of cylindrical body 160 with a portion of the inner cylindrical member 164 tightly fit into the lower inner space of the cylindrical body 160, as seen in FIG. 12.

The outer diameter of the inner cylindrical member 164 above the step 166 is smaller than the inner diameter of the adjacent section of the cylindrical body 160. In this manner, an annular space is formed between the inner cylindrical member 164 and the inner surface of the cylindrical body 160. The inner cylindrical member 164 also includes at least one opening 167 located at its upper end to allow fluid flow between the space within the inner cylindrical member 164 and the annular space, as described below.

A cap 168 encloses and seals the inner cylindrical member 164 within the cylindrical body 160. The cap 168 is suitably attached to the upper end of the cylindrical body 160 to inhibit leakage of working fluid from the actuator cylinder 146.

As seen in FIG. 12, a biasing member 170 (e.g., a disc or belleville spring) is disposed between the cap 168 and the upper end of the inner cylindrical member 164. The biasing member 170 is arranged to force together the opposing annular surfaces at the corresponding steps 162, 166 of the cylindrical body 160 and inner cylindrical member 164. The interaction between these two surfaces, as well as the interference fit between the outer and inner surfaces of the cylindrical body 160 and inner cylindrical member 164 just below the annular surfaces, seals the annular space between the cylindrical body 160 and the inner cylindrical member 164 from the lower inner space of the cylindrical body 160. Thus, the integrity of the seal does not falter even with variations in the degree of interference between the cylinders 160, 164, due to the constant engagement force provided by the biasing member 170. This construction thus improves the reliability and durability of the cylinder, as compared to the design described above in connection with FIGS. 2 and 3.

A piston 172 is disposed within the inner cylindrical member 164 and slides axially therein. A lower end of the actuator rod 154 is connected to the piston 172, as seen in FIG. 12. The piston 172 includes one or more O-rings to inhibit leakage of working fluid across the piston 172. And in this manner, the piston divides the inner space within the cylindrical body 160 and the inner member 164 into an up variable-volume fluid chamber 174, which is located below the piston 172, and a down variable volume fluid chamber 176, which is located above the piston 172. The piston 172 also can include a suitable pressure relief mechanism 178 that allows fluidic communication between the chambers 174, 176 under abnormal operating conditions, as well known in the art.

As seen in FIG. 12, the actuator cylinder 146 also includes a pair of ports 180, 182 that communicate with the up fluid chamber 174 and the down fluid chamber 176, respectively. In the illustrated embodiment, the lower port 180 opens directly into the up fluid chamber 174 through the wall of the cylindrical body 160. The upper port 182, however, opens into the annular space formed between the cylindrical body 160 and the inner cylindrical member 164. Working fluid flows between the annular space and the down fluid chamber 176 through the opening 167 located at the upper end of the inner member 164.

Figure 13:
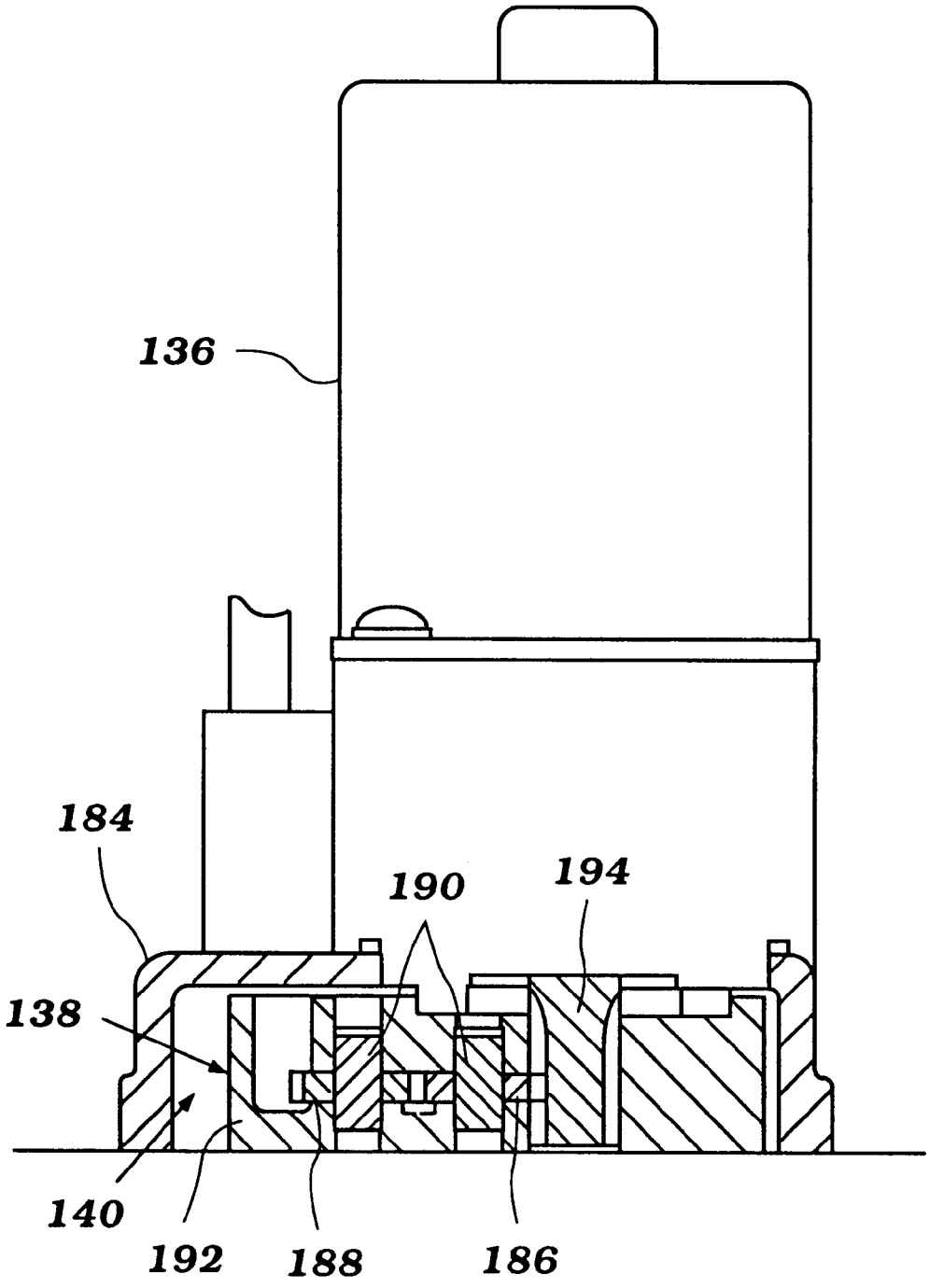
FIG. 13 is an enlarged, partial sectional view of a pump assembly of the tilt and trim adjustment system of FIG. 8.

FIG. 13 best illustrates several internal components of the powering assembly 134. A housing 184 defines an internal volume that forms the reservoir 140 of the powering assembly 134. The pump 138 preferably is located within the reservoir 140 for a compact assembly; however, the pump 138 can be external to the reservoir.

The pump 138 in the illustrated embodiment takes the form of a two-shaft type gear pump that includes a pair of impeller gears 186, 188. A shaft 190 supports each gear 186, 188, and the shafts are arranged to rotate about parallel axes. As understood from FIG. 13, the shafts and gears are separately formed to simplify fabrication and reduce manufacturing costs, as compared to the design illustrated in FIG. 4 above.

As seen in FIG. 13, a pump housing or carrier 192 supports the shafts 190 and gears 186, 188 such that the gears 186, 188 are in mesh engagement in the assembly. In the illustrated embodiment, the pump carrier 192 is arranged within and connected to the housing 184.

The pump carrier 192 also desirably includes a plurality of internal passages that communicate with a pump chamber in which the impeller gears 186, 188 are disposed. Some of these passages communicate with the reservoir 140, while other passages communicate with other valves of the hydraulic circuit, as described below.

The reversible electric motor 136 drives the pump 138, as noted above, and is connected to a source of electricity (e.g., battery) by an electric cable. In one mode, the electric motor 136 includes an output shaft 194 that drives at least one of the impeller gears 186, 188. And in the illustrated embodiment, the output shaft includes a plurality of spur gear teeth that mesh with the corresponding teeth of the first impeller gear 186. The first impeller gear 186 in turn drives the second impeller gear 188. By reversing the rotational direction of the output shaft 194, the motor 136 can drive the pump 138 in an opposite direction.

The output shaft 194 desirably rotates about the same rotational axis as does an armature 196 of the electric motor 136. A transmission, however, can operate between a motor shaft and the output shaft 194 where the two do not rotate about the same axis.

Figure 11:
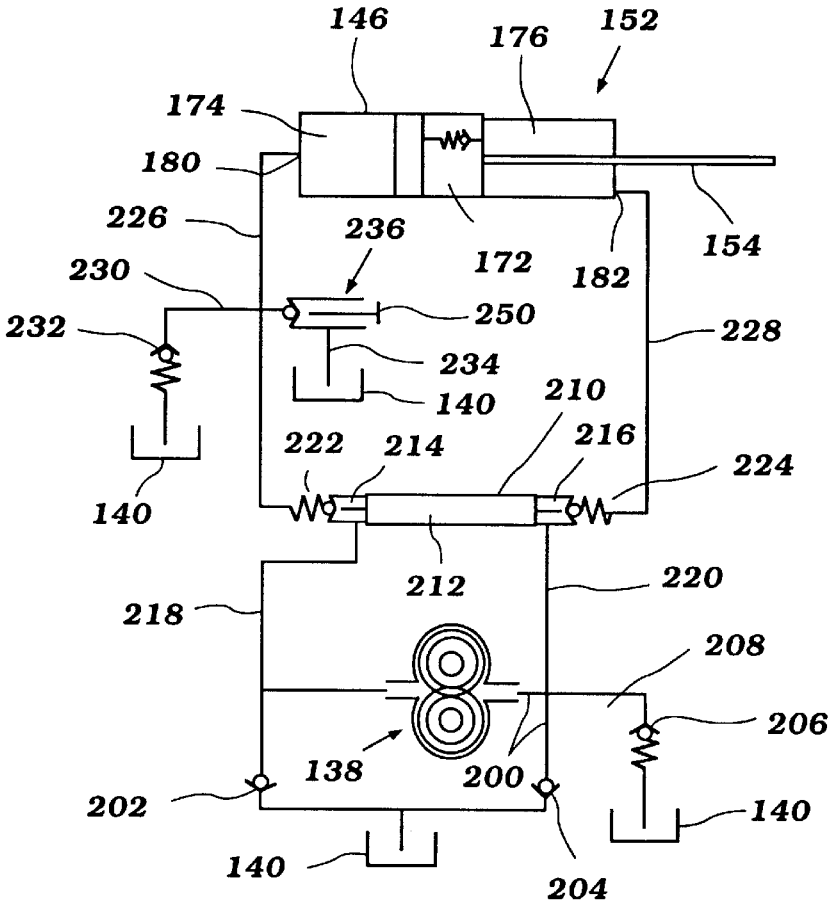
FIG. 11 is a schematic drawing of the hydraulic circuitry of the tilt and trim adjustment system of FIG. 8.

FIG. 11 schematically illustrates the hydraulic circuit of the powering assembly 134. As understood from the above description, the powering assembly 134 includes a reversible, positive displacement pump 138 that is driven by a reversible electric motor 136 (FIG. 9). The pump 138 includes a pair of inlet or suction passages 198, 200 that extend from the reservoir 140 and in which respective non-return check valves 202, 204 are provided. These passages and valves desirably are located within the pump carrier 192 (FIG. 13), as noted above.

A pump relief valve 206 is provided in a passage 208 that communicates the junction of the suction passage 200 and a delivery passage to prevent the occurrence of abnormally high pressure within the pump 138 or in the associated supply and delivery passages. The relief valve 206 opens into the reservoir 140. This passage 208 and valve 206 also are desirably located within the pump carrier 192 (FIG. 13).

A shuttle valve assembly, indicated generally by reference numeral 210, is provided downstream of the pump 138 and includes a shuttle piston 212 that divides the interior of the shuttle valve 210 into first and second chambers 214, 216. The pump 138 selectively delivers pressurized fluid to the first chamber 214 through a delivery passage 218 and receives the working fluid from the first chamber 214 through this same passage. In a like manner, the second chamber 216 communicates with the opposite side of the pump 138 through the another delivery passage 220. In the illustrated embodiment, the shuttle valve 210 is arranged within the housing 184, and desirably is supported by the pump carrier 192. The delivery passages are also preferably formed in either the pump carrier 192 or the housing 184.

A first check valve 222 regulates flow through a port on the shuttle valve that communicates with the first chamber 214. In a similar manner, a second check valve 224 controls fluid flow to and from the chamber 216. The shuttle valve piston 212 has outwardly extending pin projections that are adapted to engage the balls of the check valves 222, 224 to open these check valves, as will become apparent.

A first pressure passage 226 extends from the shuttle valve first chamber 214 to the up fluid chamber 174 of the actuator cylinder 146 through the lower cylinder port 180. A second pressure passage 228 connects the shuttle valve second chamber 216 with the down fluid chamber 176 of the actuator cylinder 146 through the upper cylinder port 182. These pressure passages 226, 228 desirably are formed within either the housing 184 or the pump carrier 192.

A high pressure relief device is provided for the up fluid chamber 174. A relief passage 130 is connected to the first pressure passage 226 at a point between the shuttle valve 210 and the lower cylinder port 180. A relief valve 232 is provided within the relief passage 230. The relief valve 232 is sized to open upon the occurrence of an abnormally high pressure and communicates directly with the reservoir 140 so as to release the working fluid from the cylinder up fluid chamber 174 and pressure passage 226 to the reservoir 140. In this manner, the high pressure relief device 232 relieves pressure within the lower branch of the hydraulic circuit.

The hydraulic circuit of the powering assembly 134 desirably has a bypass feature in order to provide manual tilt and trim adjustment when the motor 136 or pump 138 are not functioning. As will be apparent from the following description of the valve construction, the construction of the valve and associated hydraulic circuit are simplified by providing this feature only for lowering the outboard motor, and not for raising it as outboard motors are hardly ever raised by hand. Thus, the present bypass feature only allows for hydraulic fluid to return to the reservoir 140 from the up fluid cylinder 174 when manually tilted down.

A bypass passage 234 connects the first pressure passage 226 to the reservoir 140. A manual override valve 236 normally prevents fluid communication through the bypass passage 234; however, when the valve 236 is manually opened, the bypass passage 234 places the up fluid chamber 174 in communication with the reservoir 140. The outboard motor 100 then can be lowered manually. Because only the up fluid chamber 174 is connected to the reservoir 140 via the valve 236, the structure of the hydraulic circuit is simplified over other designs, such as that illustrated in FIGS. 5 and 6, which was described above.

Figure 14A:
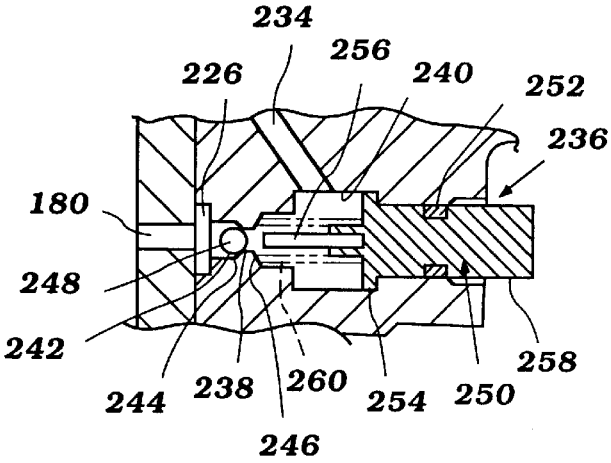
FIG. 14A is an enlarged, sectional side view of a manual valve of the hydraulic circuit of FIG. 11 with the valve in an unactuated, closed position.
Figure 14B:
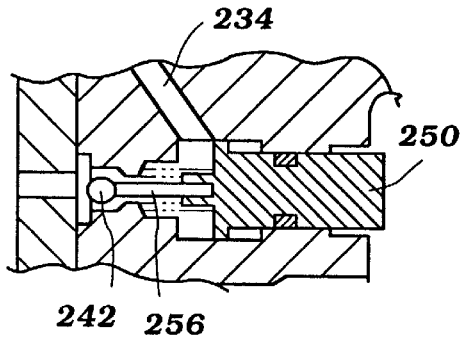
FIG. 14B is a sectional side view of the manual valve of FIG. 14A with the valve in an actuated, open position.

FIGS. 14A and 14B best illustrate the manual override valve 236. The valve 236 desirably is an axial displacement valve and includes a valve seat 238 formed between a shuttle bore 240 and a small chamber 242 within a valve housing. In the illustrated embodiment, the valve housing desirably is part of the pump carrier 192 or the reservoir housing 184 (see FIG. 13). The small chamber 242 includes tapering sides 244 that funnel toward the valve seat 238, while an annular wall 246 circumscribes the valve seat 238 on the opposite side within the shuttle bore 240. The bypass passage 234 communicates with the shuttle bore 240 at a distance away from the annular wall 246.

A valve element 248 is positioned within the small chamber 242. In the illustrated embodiment, the valve element 248 is a spherical ball having a diameter greater than the valve seat 238, the lower cylinder port 180, and the first pressure passage 226, as appreciated from FIG. 14A. The normal pressure within the pressure passage 226 keeps the valve element 248 seated against the valve seat 238. In addition, or in the alternative, a biasing keeper (e.g., compression spring) can be used to hold the valve element 248 in this position.

A shuttle 250 is positioned within the shuttle bore 240 and is sized and configured to slide within the bore 240 in a slip-fit manner. A seal 252 (e.g., an O-ring) circumscribes a portion of the shuttle's body in order to inhibit fluid leakage around the shuttle 250.

Interengaging structures between the housing and the shuttle body hold the shuttle 250 within the shuttle bore 240. In the illustrated embodiment, the shuttle 250 includes an annular ring 254 formed about its inner end. The ring 254 has a larger size than a portion of the shuttle bore 240 to prevent the shuttle 250 from sliding out of the bore 240. For this construction, the valve housing must include at least two pieces that together form the shuttle bore 240. Of course, other means can also be used to hold the shuttle 250 within the bore 240, such as, but without limitation, set screws and the like.

The shuttle 250 also includes a projection 256 that extends toward the valve seat 238. The diameter of the projection 256 is smaller than the valve seat 238 and is positioned to extend therethrough and contact the valve element 248 when actuated, as described below.

An end 258 of the shuttle 250 normally protrudes from the housing when in a closed, non-actuated state, as seen in FIG. 14A. A biasing element 260, such as a compression spring in the illustrated mode, biases the shuttle 250 into this position. The spring 260 is arranged between an inner end of the shuttle 250 and the annular wall 246 of the housing. The extent by which the shuttle end 258 protrudes provides a sufficient stroke to unseat the valve element 248 without blocking the bypass passage 234, as understood from FIG. 14B. The shuttle end 258 thus functions as a push button to actuate the valve 236, as described below. Although this push button construction has been illustrated in connection with an axial displacement valves, it is understood that such a push button feature can also be used with other types of valves (e.g., rotary).

FIGS. 8 through 10 best illustrate the arrangement and layout of the tilt and trim adjustment mechanism 102 within the coupling assembly 120. As best seen in FIG. 9, the hydraulic motor assembly 132 is arranged such that its stroke axis lies generally within a central plane that bifurcates clamping assembly 120 and the outboard motor 100. Thus, the actuator cylinder 146 lies nested between the bracket arms 127 of the swivel bracket 124 with the swivel bracket arms 127 symmetrically arranged with respect to the cylinder 146, as best seen in FIG. 10. The actuator cylinder 146 also lies symmetrically positioned between the sideplates of the clamp bracket 122. In this manner, the stroke axis of the cylinder 146 is positioned generally within the same plane in which the overall center of gravity of the outboard motor 100 and the power tilt and trim system is located.

The powering assembly 134 is located on a lower end of the actuator cylinder 146, below the bracket arms 127 of the swivel bracket 124. That is, the powering assembly 134 is located near an interaction point between the actuator cylinder 146 and the clamping bracket 122 (e.g., near the lower trunnion 148). The powering assembly 134 extends to the side of the actuator cylinder 146 beyond one of the swivel bracket arms 127. In this position, the pump 138, as well as the reservoir 140 and the associated hydraulic circuit, lie near the up fluid chamber 174 and the lower port 180 of the actuator cylinder 146, on the lower half of the cylinder 146. Consequently, the powering assembly 134 lies at the lower end of the hydraulic motor 132 so that the swivel and clamp brackets 124, 122 do not have to be widened to accommodate the combined width of the motor and power assemblies 132, 134, as is the case with the component layout illustrated in FIG. 1.

In the illustrated embodiment, as best seen in FIG. 9, the powering assembly 134 projects in the lateral direction. The reservoir 140 and the pump 138 are arranged adjacent to the cylinder body 160 with the electric motor 136 positioned at the outer lateral end of the assembly 134. The axes of the motor output shaft 194 and the axes of the pump impeller gear shafts 190 all desirably lie generally normal to the stroke axis of the actuator cylinder 146 in this arrangement.

As appreciated in FIGS. 8 and 9, the exposed end 258 of the manual override valve 236 lies in the vicinity of the lower end of the actuator cylinder 146, next to the electric motor 136 in a location easily accessible. This position permits a person to actuate the valve 236, by depressing the valve 236 (i.e., pushing the exposed end 258 of the valve 236 into the housing 182), while pushing down on the outboard motor 100 to lower it.

The pump 138 includes a pair of outlet ports that communicate with the inlet ports 180, 182 formed in the hydraulic motor assembly 132. It should be noted that the outer housings of the assemblies 132, 134 may be common or, the assemblies may comprise separate pieces that are affixed to each other. By having interfitting ports, the necessity for providing external conduits is avoided and the construction is more compact.

To trim, as well as tilt up the motor 100, the pump 138 rotates in a direction to pressurize the first delivery passage 218 and the first chamber 214 of the shuttle valve 210. In doing so, the shuttle valve 210 opens to connect the down fluid chamber 176 to the suction side of the pump 138. The pressurized fluid forces open the check valve 222 and pressurizes the up fluid chamber 174 of the actuator cylinder 146 to extend the actuator rod 154 and raise the outboard motor 100. That is, the propulsion device 118 of the outboard motor is raised as the extending actuator cylinder 146 causes the swivel bracket 124 to rotate about the pivot pin 128.

The pump 138 draws working fluid from the down fluid chamber 176 during this process. The pump 138 may also draw additional working fluid from the reservoir 140 through the pickup passage 204.

To lower the motor 100, the pump 138 rotates in an opposite direction to pressurize the second delivery passage 220 and the second chamber 216 of the shuttle valve 210. The shuttle valve 210 consequently opens to connect the up fluid chamber 174 to the suction side of the pump 138. The pressurized fluid forces open the check valve 224 and pressurizes the down fluid chamber 176 of the actuator cylinder 146 to extend the actuator rod 154 and lower the outboard motor 100. That is, the propulsion device 118 of the outboard motor is lowered as the retracting actuator cylinder 146 causes the swivel bracket 124 to rotate about the pivot pin 128.

The pump 138 draws working fluid from the up fluid chamber 174 during this process. The pump 138 may also draw additional working fluid from the reservoir 140 through the pickup passage 202.

To lower the outboard motor manually, the exposed end 258 of the override valve 236 is pressed and held inward. This causes the shuttle 250 to slide within the shuttle bore 240 to a position where the projection 256 unseats the valve element 248. Working fluid from the up fluid chamber 174 of the actuator cylinder 146 flows through the valve seat 238, through the bypass line 234 and into the reservoir 140. Without the presence of the working fluid to support the weight of the outboard motor 100, the outboard motor 100 is easily lowered principally under its own weight. With the outboard motor 100 lowered to a desired position, the override valve 236 is released and the spring 260 biases the exposed end 258 of the valve 236 back to its non-actuated position.

Figure 15:
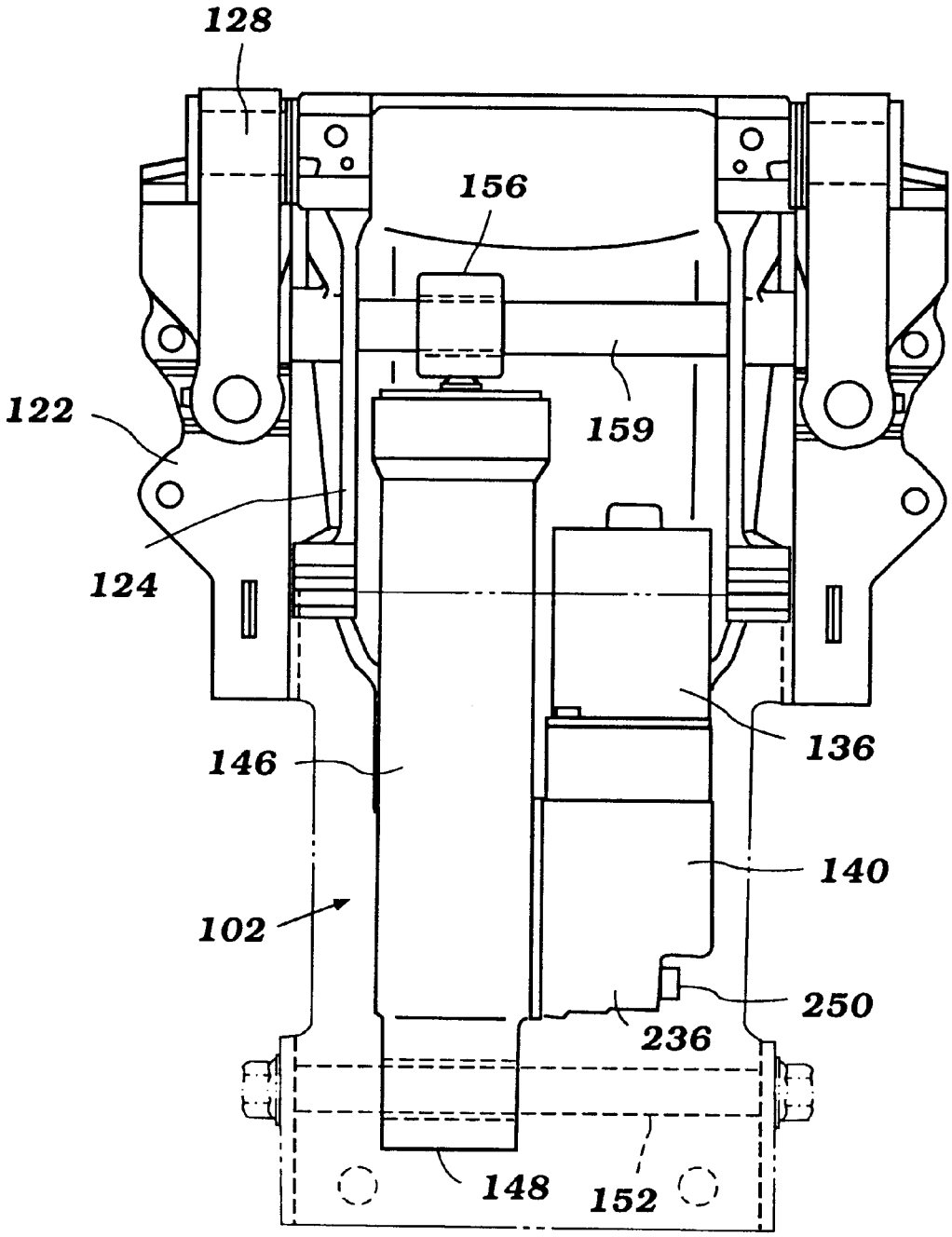
FIG. 15 is a front elevational view of a tilt and trim adjustment system configured in accordance with another embodiment of the present invention.
Figure 16:
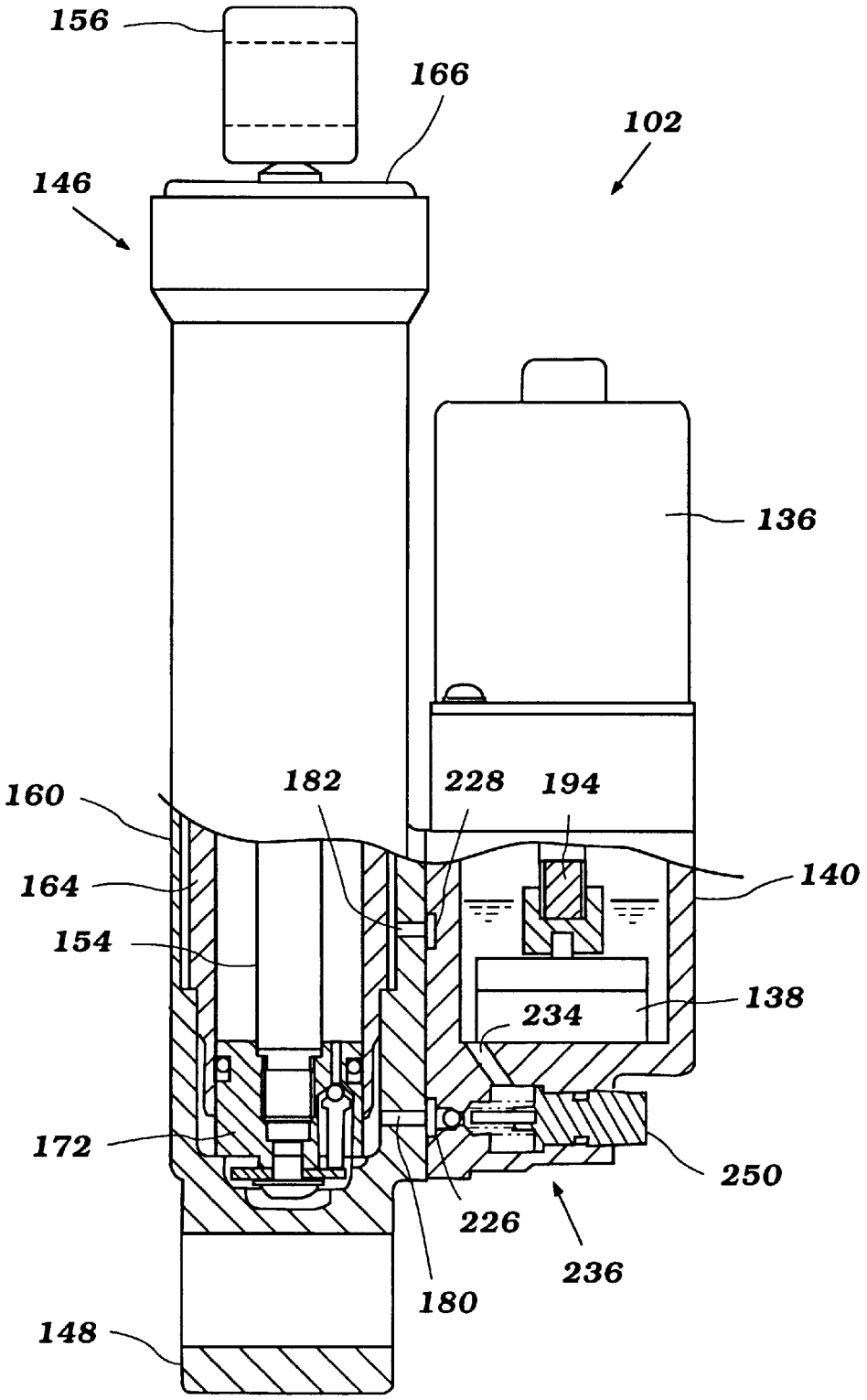
FIG. 16 is an enlarged, partial sectional view of the tilt and trim adjustment system of FIG. 15.
Figure 17:
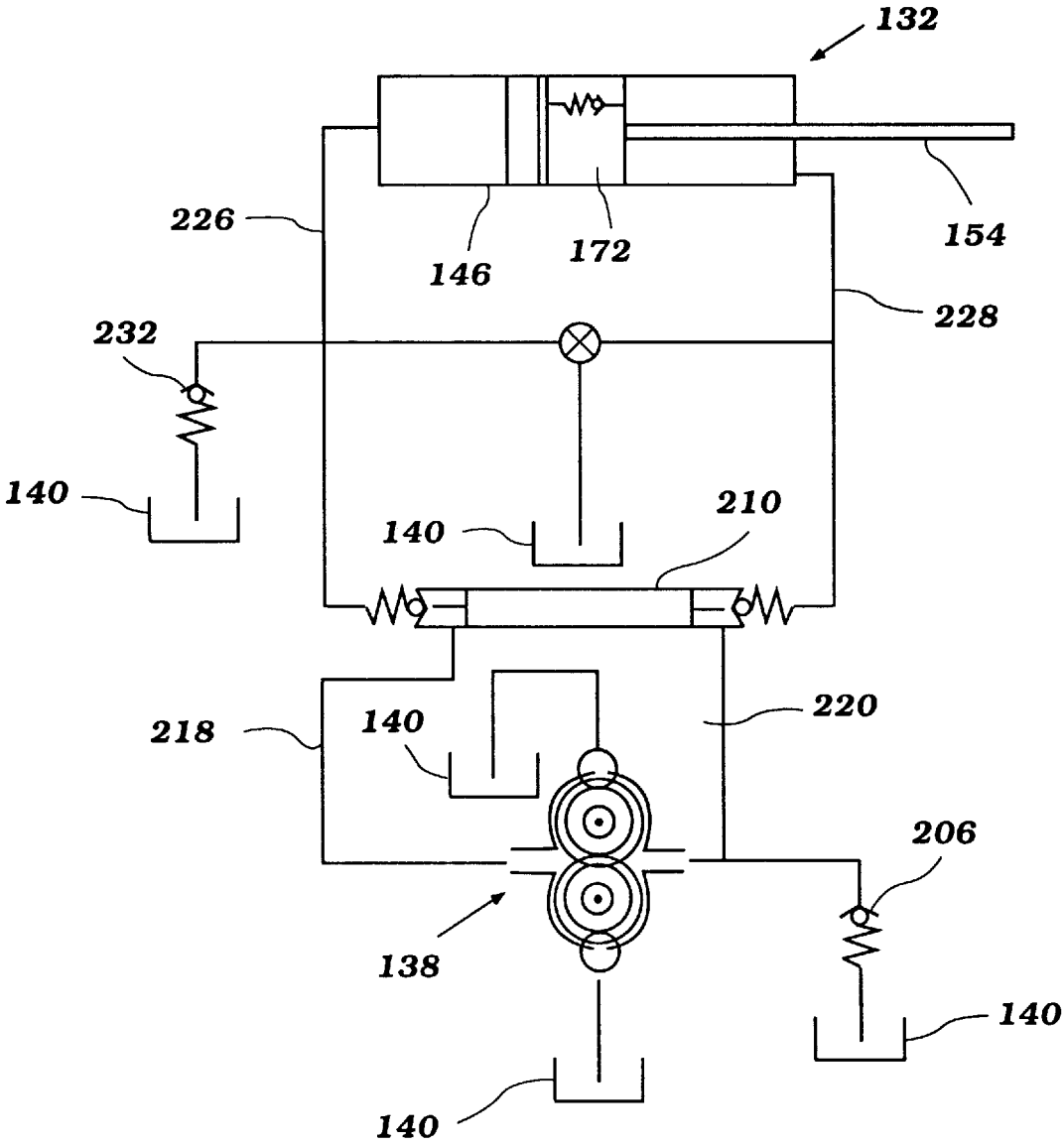
FIG. 17 is a schematic drawing of a hydraulic circuit of a tilt and trim adjustment system configured in accordance with another embodiment of the present invention.

FIGS. 15 through 17 illustrate additional embodiments of the present tilt and trim adjustment system. Like reference numerals have been used to indicate similar components between each of the embodiments. Accordingly, the above description of common components should apply equally to those of the following embodiments, unless otherwise indicated.

These embodiments illustrate that many of the above described features need not be used in combination. For instance, as illustrated in FIGS. 15 and 16, a tilt and trim adjustment system 102 is depicted which includes the above-described manual override valve 236, with its push button actuator, but does not include the above-described layout of the powering assembly 134. That is, the powering assembly 134 is arranged to extend generally parallel with and along side the actuator cylinder 146, but the system is adapted to include the present manual override valve 236. FIG. 17 schematically illustrates a hydraulic circuit that can be incorporated into a tilt and trim adjustment system arranged in accordance with the above description, but omits the above-described manual override valve.

The above described tilt and trim adjustment mechanism has a more compact configuration so as to position the actuator cylinder at the center of the assembly. A smaller cylinder thus can be used so as to lighten the overall weight to the power tilt and trim system. In addition, a less complicated hydraulic circuit is obtained with the present manual override valve to reduce manufacturing costs and decrease the size of the powering assembly. The valve is also more easily operated and does not require any tools.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A tilt and trim adjustment mechanism for an outboard motor having a clamp bracket and a swivel bracket, comprising an actuator having at least a first variable volume fluid chamber and an extendable rod, the actuator arranged to operate generally between the clamp and swivel brackets, a pump selectively supplying a working fluid to the first fluid chamber of the actuator so as to move the rod, the pump being located within a reservoir of working fluid, and a motor selectively driving the pump, the pump and motor being located near to an interaction point between the actuator and the clamp bracket, at the lower side of the actuator.

2. A tilt and trim adjustment mechanism as in claim 1, wherein the actuator includes a cylindrical body, and the pump is positioned next to a lower half of the cylinder body.

3. A tilt and trim adjustment mechanism as in claim 1, wherein the actuator includes a second variable volume fluid chamber, a fluid port communicating with each fluid chamber, and a piston attached to the extendable rod, the piston being located between the first and second fluid chambers, with the first chamber being arranged to extend the rod with the introduction of working fluid through the corresponding fluid port, and the motor and pump are located in proximity to the fluid port communicating with the first fluid chamber.

4. A tilt and trim adjustment mechanism as in claim 1, wherein the motor rotates an element of the pump about a rotational axis that is generally normal to an axis of the actuator rod.

5. A tilt and trim adjustment mechanism as in claim 4, wherein the pump includes a plurality of impeller gears, and at least one of the gears is driven by a gear formed on the end of an output shaft of the motor.

6. A tilt and trim adjustment mechanism as in claim 1, wherein the reservoir is positioned between the actuator and the motor.

7. A tilt and trim adjustment mechanism as in claim 6 additionally comprising a valve operating between the pump and the actuator, the valve being located within a housing that defines the reservoir.

8. A tilt and trim adjustment mechanism as in claim 1, wherein the pump includes a carrier that supports a rotational member of the pump within a pump cavity defined within the carrier, and the carrier includes at least one passage that communicates with the reservoir and at least one passage that communicates with the fluid chamber of the actuator.

9. A tilt and trim adjustment mechanism as in claim 1 additionally comprising an axial displacement valve assembly having a push button and a valve element, the valve member being positioned to selectively place the fluid chamber of the actuator in communication with the reservoir when actuated by the push button, the push button being located on the tilt and trim adjustment system so as to be accessible for manual operation.

10. A tilt and trim adjustment mechanism for an outboard motor having a clamp bracket and a swivel bracket, comprising an actuator having at least a first variable volume fluid chamber and an extendable rod, the actuator including an outer cylinder member and an inner cylinder member placed within the outer cylinder member, the cylinder members having opposing annular surfaces located at a distance spaced from corresponding ends of the cylinders, and a biasing member forcing together the annular surfaces, the actuator arranged to operate generally between the clamp and swivel brackets, a pump selectively supplying a working fluid to the first fluid chamber of the actuator so as to move the rod, and a motor selectively driving the pump, the pump and motor being located near to an interaction point between the actuator and the clamp bracket, at the lower side of the actuator.

11. A tilt and trim adjustment mechanism for an outboard motor comprising an actuator having a rod extendable along a stroke axis, a pump that selectively supplies a working fluid to the actuator so as to move the rod, and a motor selectively driving the pump, the pump including a rotary fluid motivation element that rotates about a rotational axis, the pump being positioned next to the actuator and oriented such that the rotational axis lies generally normal to the stroke axis of the actuator.

12. A tilt and trim adjustment mechanism of claim 11, wherein the motor includes an output shaft that rotates about a drive axis, and the motor is oriented such that the drive axis lies generally normal to the stroke axis.

13. A tilt and trim adjustment mechanism of claim 12, wherein the drive axis of the motor output shaft and the rotational axis of the pump are coaxial.

14. A power tilt and trim system for an outboard motor comprising a support member that couples to the outboard motor, the support member including a pair of bracket arms spaced apart from each other, an actuator nested between the bracket arms, and a pump assembly arranged next to the actuator, at least a portion of the pump assembly extending beyond one of the bracket arms.

15. A tilt and trim adjustment mechanism comprising an actuator including a first variable volume fluid chamber, a second variable volume fluid chamber and a piston positioned between the first and second fluid chambers, a pump selectively communicating with one of the first and second fluid chambers through a fluid circuit and with a fluid reservoir, the fluid circuit including a manually operated valve positioned within the fluid circuit to selectively place only the first chamber in communication with the reservoir when operated.

16. A tilt and trim adjustment mechanism as in claim 15, wherein the valve is positioned in the vicinity of a lower end of the actuator.

17. A tilt and trim adjustment mechanism as in claim 15, wherein the actuator is coupled to a drive unit, and the drive unit is lifted up with a movement of the piston when the first fluid chamber is supplied with a working fluid.

18. A tilt and trim adjustment mechanism as in claim 16, wherein the pump is located within a reservoir of working fluid.

19. A tilt and trim adjustment mechanism as in claim 15, wherein the valve includes a push button actuator that is arranged to be accessible for manual operation.

20. A tilt and trim adjustment mechanism comprising an actuator including a first variable volume fluid chamber, a second variable volume fluid chamber and a piston positioned between the first and second fluid chambers, a pump selectively communicating with one of the first and second fluid chambers through a fluid circuit and with a fluid reservoir, the fluid circuit including a manually operated valve positioned within the fluid circuit to selectively place only the first chamber in communication with the reservoir when operated, the valve being positioned in the vicinity of a lower end of the actuator, and the valve including a push button actuator that is arranged to be accessible for manual operation.

21. A tilt and trim adjustment system comprising an actuator including at least one variable volume fluid chamber, a pump that selectively supplies a working fluid to the fluid chamber of the actuator through a fluid circuit, and a reservoir containing working fluid, the fluid circuit including a valve assembly having a push button and a valve member, the valve member being positioned within the fluid circuit to selectively place the fluid chamber of the actuator in communication with the reservoir when actuated by the push button, the push button being located on the tilt and trim adjustment system so as to be accessible for manual operation.

22. A tilt and trim adjustment mechanism as in claim 21, wherein the valve assembly comprises an axial displacement valve member.

23. A tilt and trim adjustment mechanism as in claim 21, wherein the valve is positioned in the vicinity of a lower end of the actuator.

24. A tilt and trim adjustment mechanism as in claim 21, wherein the valve assembly in integrated with a housing that contains the reservoir.

25. A tilt and trim adjustment mechanism as in claim 24, wherein the pump is located within the housing.

26. A tilt and trim adjustment mechanism for an outboard motor having a clamp bracket and a swivel bracket, comprising an actuator having at least a first variable volume fluid chamber and an extendable rod, the actuator arranged to operate generally between the clamp and swivel brackets, a pump selectively supplying a working fluid to the first fluid chamber of the actuator so as to move the rod, and a motor selectively driving the pump, the pump including a plurality of impeller gears, at least one of the gears being driven by a gear formed on the end of an output shaft of the motor.

27. A tilt and trim adjustment mechanism as in claim 26, wherein the impeller gears are supported by shafts arranged to rotate about parallel axes.

28. A tilt and trim adjustment mechanism as in claim 27, wherein the parallel axes are disposed parallel to an axis of the output shaft.

* * * * *